US005732543A

United States Patent [19]

Bungter et al.

[11] Patent Number: 5,732,543

[45] Date of Patent: Mar. 31, 1998

[54] OPEN-END SPINNING MACHINE FOR PRODUCING CHEESES

[75] Inventors: Helmut Bungter, Viersen; Jürgen Backhaus, Wegberg, both of Germany

[73] Assignee: W. Schlafhorst AG & Co., Moenchengladbach, Germany

[21] Appl. No.: 693,874

[22] Filed: Aug. 5, 1996

[30] Foreign Application Priority Data

Aug. 11, 1995 [DE] Germany ..... 195 29 654.0

[51] Int. Cl.[6] ..... D01H 11/00

[52] U.S. Cl. ..... 57/301; 57/406; 57/263

[58] Field of Search ..... 57/301, 406, 408, 57/409, 410, 411, 412, 413, 263

[56] References Cited

U.S. PATENT DOCUMENTS

| | | | |
|---|---|---|---|
| 4,505,101 | 3/1985 | Kurushima et al. | 57/301 |
| 4,514,972 | 5/1985 | Stahlecker | 57/301 |
| 4,541,233 | 9/1985 | Raasch et al. | 57/263 |
| 4,559,774 | 12/1985 | Stahlecker | 57/263 |
| 4,561,242 | 12/1985 | Stahlecker | 57/263 |
| 4,563,871 | 1/1986 | Stahlecker et al. | 57/263 |
| 4,598,539 | 7/1986 | Stahlecker et al. | 57/263 |
| 4,680,925 | 7/1987 | Bischofberger et al. | 57/263 |
| 4,781,017 | 11/1988 | Hoeber | 57/301 |
| 4,835,957 | 6/1989 | Stahlecker et al. | 57/301 |
| 4,864,679 | 9/1989 | Briner | 57/301 |
| 5,182,903 | 2/1993 | Stahlecker | 57/301 |
| 5,385,009 | 1/1995 | Schuller | 57/263 |
| 5,540,043 | 7/1996 | Raasch | 57/301 |

FOREIGN PATENT DOCUMENTS

| | | |
|---|---|---|
| 24 40 224 A1 | 3/1976 | Germany . |
| 24 58 538 A1 | 6/1976 | Germany . |
| 26 58 437 A1 | 6/1978 | Germany . |
| 26 58 441 A1 | 6/1978 | Germany . |
| 26 58 752 A1 | 7/1978 | Germany . |
| 33 37 524 A1 | 5/1984 | Germany . |
| 33 13 926 A1 | 10/1984 | Germany . |
| 36 40 001 A1 | 5/1988 | Germany . |
| 37 05 924 A1 | 9/1988 | Germany . |
| 38 01 964 A1 | 7/1989 | Germany . |
| 40 01 255 A1 | 7/1991 | Germany . |

OTHER PUBLICATIONS

Schlafhorst brochure on the "Autocoro" machine, Jan. 1991.

*Primary Examiner*—Daniel P. Stodola
*Assistant Examiner*—Tina R. Taylor
*Attorney, Agent, or Firm*—Kennedy Covington Lobdell & Hickman, LLP

[57] ABSTRACT

A pneumatic cleaning device (10) for the spinning stations of an open-end spinning machine (1) is disposed on the sliver draw-in arm (22) of a traveling service unit (16) for unitary movement with the draw-in arm between a resting position (I) and an operating position (II). In the operating position (II), two suction nozzles of the cleaning device are positioned in the area of the sliver opening device of a spinning station at which the service unit is positioned. One suction nozzle is pivotable by an electric motor drive acting through a lever linkage arrangement to cover the area below the dirt outlet opening of the sliver opening device.

6 Claims, 4 Drawing Sheets

OPEN-END SPINNING MACHINE FOR PRODUCING CHEESES

FIELD OF THE INVENTION

The present invention relates to multi-station open-end spinning machines for producing cheeses, and more particularly to such machines having a service unit for traveling movement along the spinning stations for automatically repairing yarn breaks, and wherein each of the spinning stations has a sliver-opening device with a dirt outlet opening and a mechanical dirt removal device for the spinning machine is disposed below the sliver opening devices.

BACKGROUND OF THE INVENTION

Various methods and devices are known for use in connection with sliver opening devices of cheese-producing open-end spinning machines for the removal of dirt particles accumulating in the course of the opening of the sliver.

For example, German Patent Publication DE 24 58 538 A1 discloses an open-end spinning machine whose sliver opening devices are respectively equipped with separate dirt collecting chambers. In addition, a maintenance cart moving about the open- end spinning machine serves to empty and clean the dirt collection chambers when it is positioned at the individual spinning stations. Since another traveling service unit patrols around the outside of the open-end spinning machine to perform further maintenance operations, particularly the reattachment of yarn following a yarn break, an uneven cleaning cycle results, because yarn attachment takes priority over cleaning to avoid the yarn production losses which would otherwise occur. Uneven cleaning cycles still occur, even if the two maintenance units are combined into a single service unit. As a result there is the risk that removed dirt particles are again aspirated via the dirt outlet opening of the opening roller housing, which results in yarn slubs, yarn breaks or other disruptions of the spinning process.

German Patent Publication DE 36 40 001 A1 discloses another open-end spinning machine, wherein each spinning station has a sliver opening device with a dirt removal opening to which a separate stationary dirt catch basin is assigned. A cleaning cart patrols between two rows of the spinning stations and empties the dirt catch basins by means of a special suction nozzle. Although a certain continuity in removing the dirt particles is assured with such a device, the installation is relatively expensive in its structural design since a second traveling service unit is required in any case.

Another open-end spinning machine is described in German Patent Publication DE 33 37 524 A1, whose spinning stations have a pneumatic dirt removal means. In this type of dirt removal arrangement, a dirt outlet opening disposed at the bottom of the opening roller housing is directly connected with a suction device specific to the spinning machine, so that the resulting dirt is continuously vacuumed off. However, such pneumatic vacuum devices pose the danger that the additional suction air flow can result in an impairment of the desirable flow conditions inside the opening devices.

In attempting to achieve the optimal processing of fiber materials, the removal of dirt at the opening roller housing of an open-end spinning machine represents an important element. Even though the technology of dirt removal devices appears to be relatively simple, these devices are still very complicated mechanisms which react sensitively to changes in the flow conditions. Even small modifications of the dirt removal arrangement can negatively affect the result, not only in respect to the amount of dirt removed, but also to the spinning result as a whole.

A mechanical dirt removal arrangement for an open end spinning machine is described on page 1.3.20 of Issue 4/92 of the manual "Autocoro" of the Schlafhorst company. This dirt removal arrangement has separate dirt removal belts on each side of the open end spinning machine, which are guided in upwardly open guide channels over the entire length of the machine to extend below the dirt outlet openings of the sliver opening devices of the individual spinning stations.

Thus, the dirt particles exiting from the dirt outlet openings of the opening roller housings fall on the circulating dirt removal belt and are immediately carried off. These known installations have proven themselves in actual use and are employed in large numbers. However, in the course of extended operation with very dusty raw material, fiber remnants, neps, dirt particles and the like can collect in the area of the sliver opening devices, particularly in the area of the dirt outlet openings, so that these areas must be manually cleaned at defined time intervals.

OBJECT AND SUMMARY OF THE INVENTION

It is accordingly an object of the present invention to provide an improved dirt removal device for cheese-producing open-end spinning machines of the basic type described above, particularly in machines utilizing a belt or other mechanical dirt removal means such as the "Autocoro" machine.

The present invention is basically adapted to essentially any cheese-producing open-end spinning machine comprising a plurality of spinning stations, each having a sliver-opening device with a dirt outlet opening, a mechanical dirt removal device disposed below the sliver opening device, and a traveling service unit movable along the spinning stations for automatically repairing yarn breaks. According to the present invention, the service unit is provided with a pneumatic cleaning device with at least one suction nozzle positionable during operation of the service unit in an area between the sliver opening device and the mechanical dirt removal mechanism for cleaning dirt therefrom.

The described design of the service units in accordance with the present invention has the advantage that the spinning stations are regularly and carefully cleaned during each service operation, at least in the area between the sliver opening device and the dirt removal mechanism which is most severely endangered by dirt.

In an advantageous embodiment, the cleaning device is fastened directly on the sliver draw-in arm typically provided on the traveling service unit and, with each new yarn-threading operation, is therefore automatically pivoted into its operating position wherein the suction nozzle can work the affected areas well.

Preferably, the cleaning device is mounted on a simply constructed angled frame which is affixed to the side of the draw-in arm. The suction nozzle is pivotably arranged to be reciprocated via a lever linkage arrangement, and in the operating position, covers a relatively wide area so that an extensive and thorough cleaning of the endangered areas of the spinning stations is assured.

A cost-effective, dependable and easily accessible drive for the suction nozzle and the linkage arrangement can be accomplished by providing the cleaning device with an electrical motor connected to the lever linkage arrangement via an eccentric drive for reciprocatory displacement of the suction nozzle.

The cleaning effect can be further increased by means of another suction nozzle disposed above the first-mentioned suction nozzle to apply suction on an upper area of the sliver opening device. Cleaning of the upper sections of the opening devices, which as a rule are less endangered by dirt, is particularly assured in this way.

Further details of the invention can be found in an exemplary embodiment, described fully below with reference to the accompanying drawings.

DETAILED DESCRIPTION OF THE PREFERRED EMBODIMENT

Figure 1:
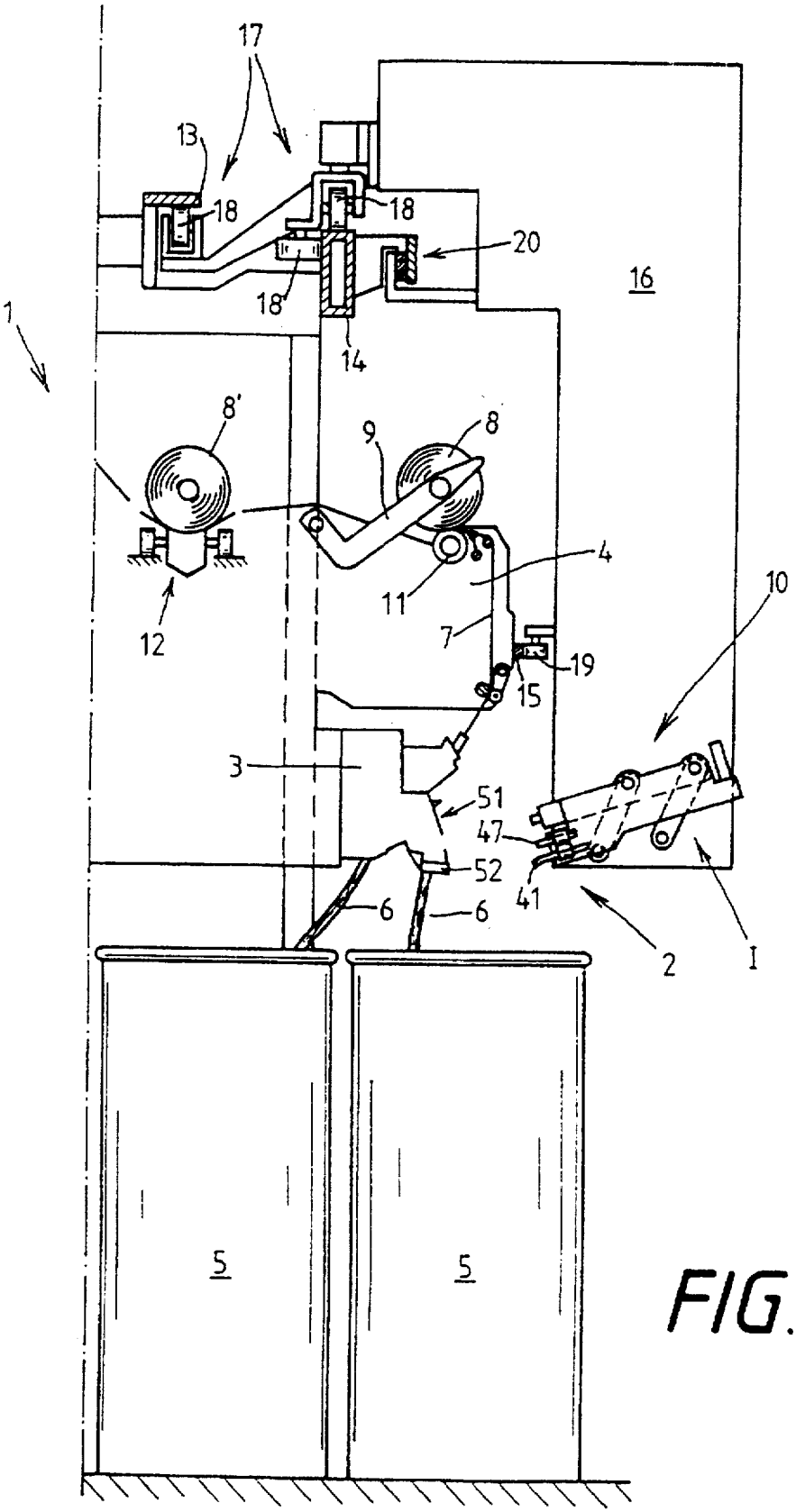
FIG. 1 is a schematic end view of one side of an open-end spinning machine having a traveling service unit equipped with a cleaning device in accordance with the preferred embodiment of the present invention.

One side of an open-end spinning machine of the basic known type described above is indicated in FIG. 1 and identified by 1. Spinning machines of this type have a plurality of spinning stations 2 each of which are equipped with a spinning box 3 and a winding device 4. A sliver 6 is fed from sliver cans 5 upwardly into the spinning boxes 3, wherein the sliver 6 is spun into yarn 7 which is delivered upwardly to be subsequently wound into cheeses 8 or 8' on the winding devices 4. As shown, the winding devices 4 are equipped with a winding frame 9 for rotatably holding an empty tube or a cheese 8 against a winding drum 11 for driving the cheese. The spinning boxes 3 are of a known construction having a belt-type mechanical dirt removal mechanism 52 underneath a sliver opening device 51, more fully shown in FIG. 4. In addition, the open-end spinning machine 1 has a circulating tube and spool transport arrangement 12 for delivering empty tubes to and removing wound cheeses from the spinning stations.

A service device, for example a traveling service unit 16, is disposed on the spinning machine 1 for movement laterally adjacent the spinning stations 2 on guide rails 13, 14 and a support rail 15. The running gear 15 of this service unit 16 includes rollers 18 and a support wheel 19. The service unit 16 is supplied with electrical energy, for example, by means of a wiper-type contact device, as indicated at 20. Service units 16 of this basic type continuously patrol along the open-end spinning machine 1 and act independently if the need for action arises at one of the work stations 2, for example, if a yarn break has occurred at a work station 2 or when a cheese has reached its prescribed diameter and must be exchanged for an empty tube at one of the work stations.

In such a case, the service unit 16 moves into position in front of the affected spinning station and, in case of a yarn break, manipulates a yarn searching nozzle (not shown) on the service unit to locate the broken yarn end lying on the circumferential surface of the cheese 8. After cleaning of the spinning box 3, the yarn end is again inserted into the rotor (not indicated) within the spinning box to continue yarn spinning from the ring of fibers rotating therein.

The working devices required for reattachment of the yarn and for cleaning the spinning box, as well as their mode of operation, are known, for example, from German Patent Publications DE 38 01 964 A1 or DE 33 13 926 A1. A representation of these devices is therefore omitted in FIG. 1 for reasons of improved clarity.

Figure 2:
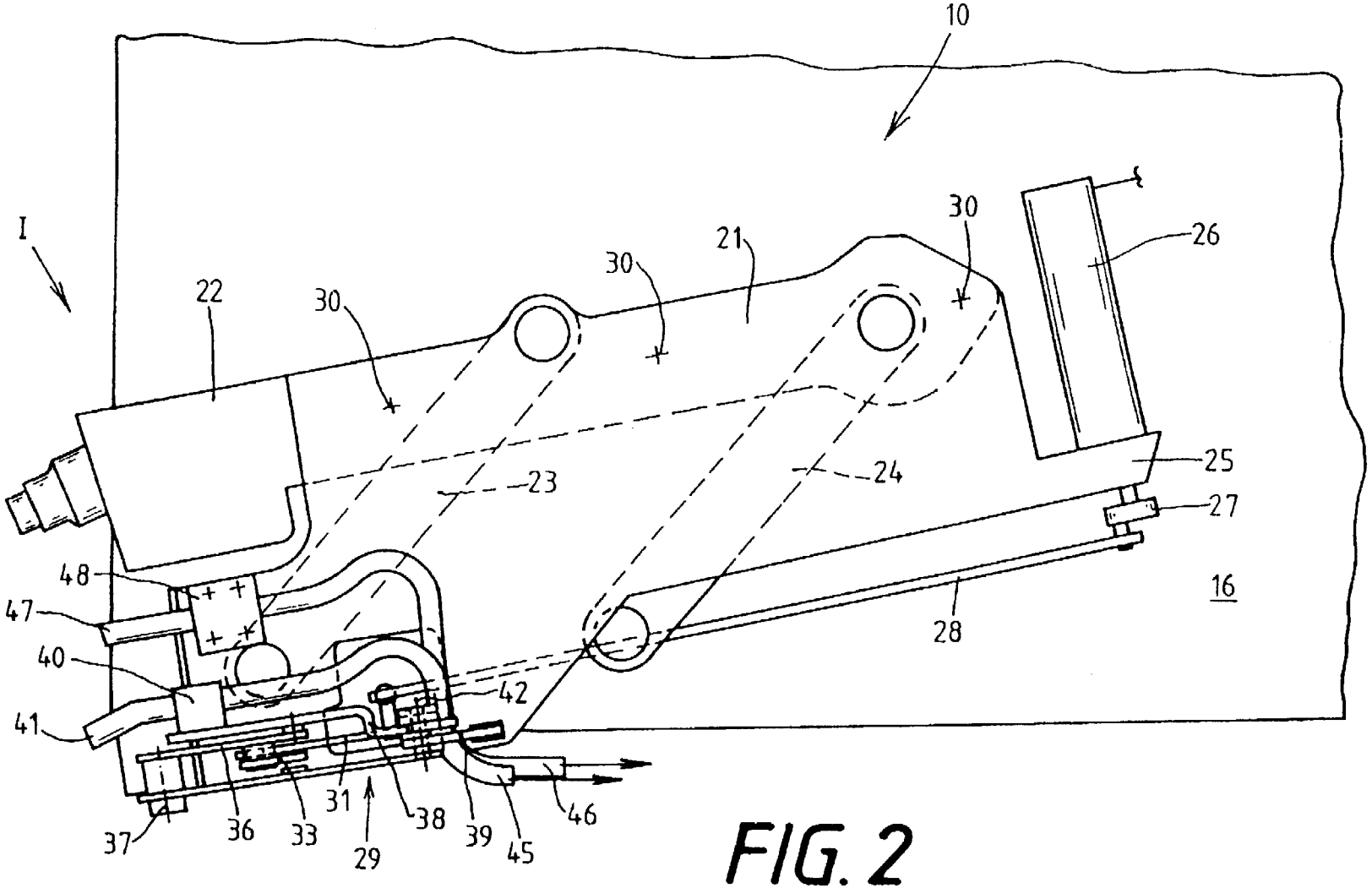
FIG. 2 is a lateral view of the cleaning device in accordance with the present invention in its resting position.
Figure 3:
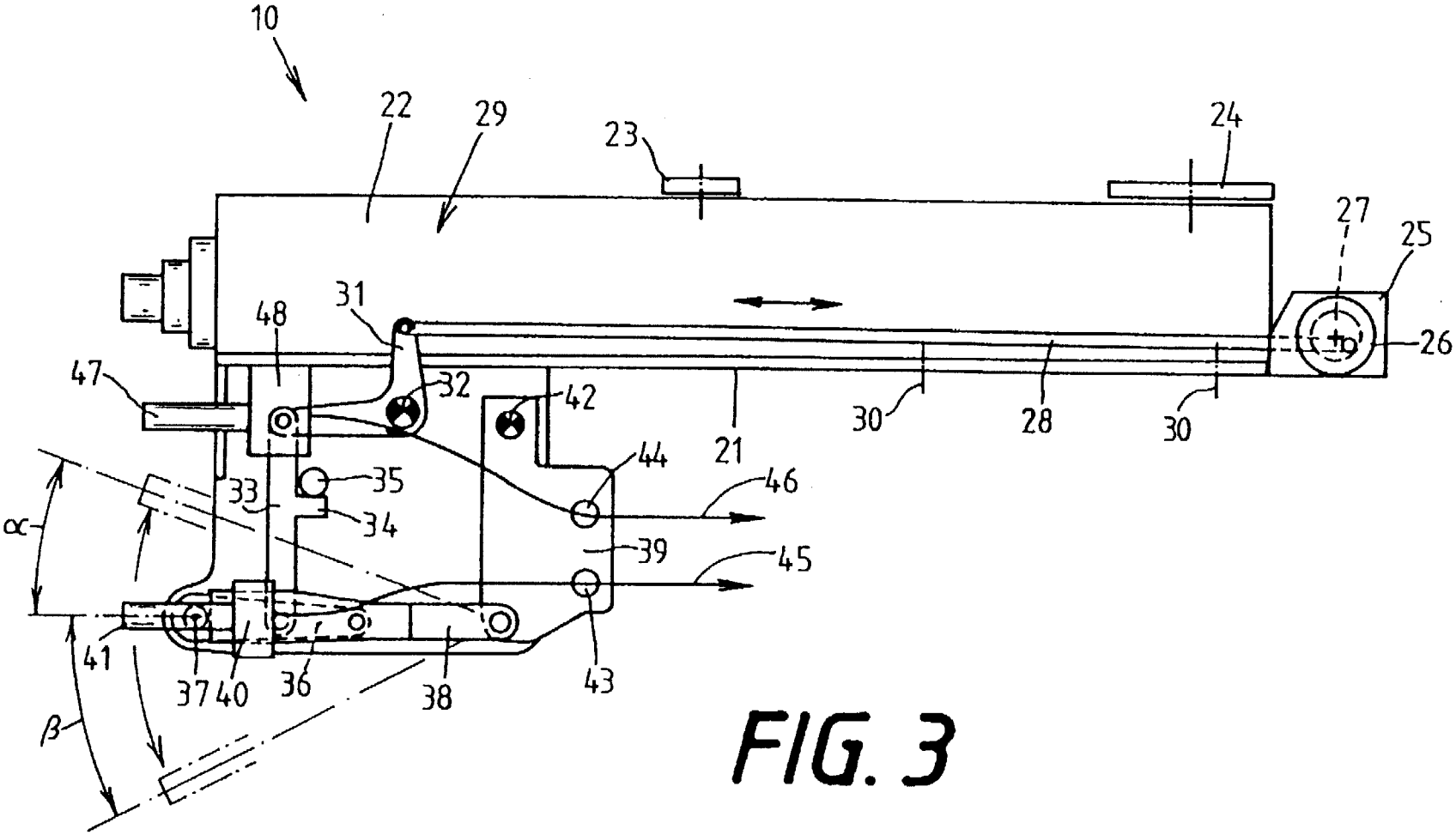
FIG. 3 is a top plan view of the cleaning device of FIG. 2.
Figure 4:
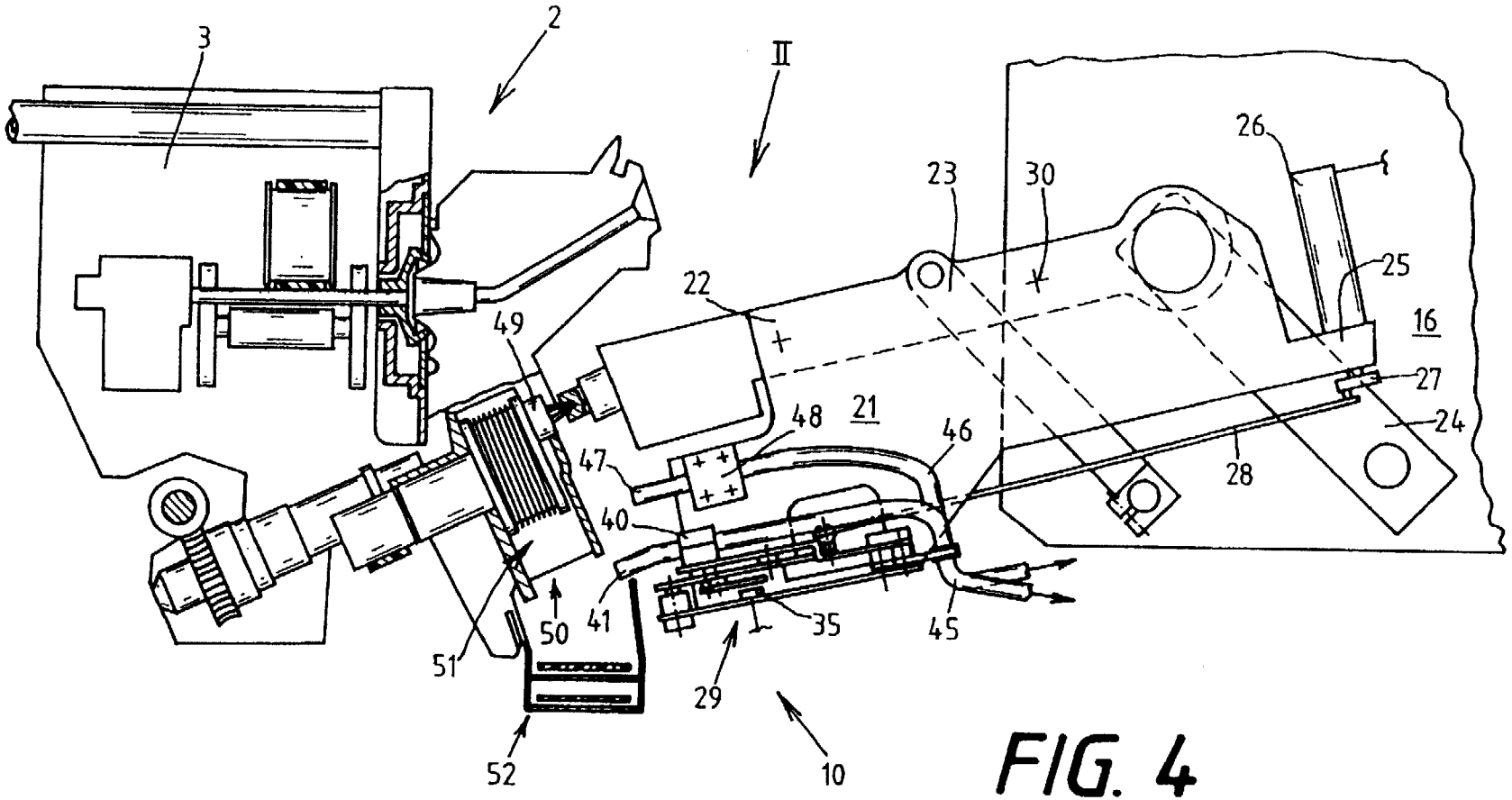
FIG. 4 is another lateral view of the cleaning device similar to FIG. 2 but depicted in the course of its operation on the open-end spinning machine.

The cleaning device 10 in accordance with the present invention is shown in an inactive resting position (I) in FIG. 1. FIGS. 2, 3 and 4 show the cleaning device 10 in greater detail.

As shown in FIGS. 2 and 3, the cleaning device 10 has an angled frame 21, which is fastened on the fiber draw-in arm 22 of the service unit 16 by means of threaded bolts or the like, representatively indicated at 30. As is known, the fiber draw-in arm 22 is supported by a parallelogram drive with pivot arms 23, 24 by which it can be moved from the resting position (I) represented in FIG. 2 into an operative working position (II) indicated in FIG. 4.

An electric motor drive 26 is disposed on a rear console 25 of the angled frame 21, the motor 26 supporting a drive disk 27 to which is eccentrically affixed a connecting rod 28 of a lever linkage arrangement, indicated as a whole at 29. Specifically, as best seen in FIG. 3, the connecting rod 28 is connected to one end of an angled lever 31 which is seated to be partially pivotable on a pivot shaft 32. A transverse lever 33 is connected to the other end of the angled lever 31 and has a switching lug 34 for damping a sensor 35 which controls pivoting of the suction nozzle 41.

The transverse lever 33 is connected with a bearing lever 36, which is pivotable on a pivot shaft 37 and is also connected to an elongate transport lever 38. The rearward end of the transport lever 38 is rotatably connected with a bearing plate 39 and the forward end portion of the transport lever 38 carries a clamping device 40 to which a suction nozzle 41 is fixed. The bearing plate 39 is pivotable about a pivot shaft 42 and has receiver openings 43, 44 through which suction lines 45, 46 pass.

The rotating movement of the drive disk 27 of the electric motor drive 26 drives motion of the various components of the lever linkage arrangement 29 via a translatory reciprocating movement of the connecting rod 28 ultimately resulting in a reciprocating pivotal displacement of the suction nozzle 41 over the angles $\partial$ and $\beta$.

As shown in the drawing figures, in addition to the pivotably seated suction nozzle 41, the cleaning device 10 may have a further suction nozzle 47 rigidly fastened to the angled frame 21 by means of a clamping device 48 at a slightly higher disposition and slightly laterally offset in respect to the suction nozzle 41. The suction nozzles 41, 47 are connected to their vacuum sources (not shown) via the connecting lines 45, 46.

The functioning of the cleaning device 10 may thus be understood with reference to FIG. 4. When the service unit 16 has been called to a spinning station 2 (only the area of the spinning box 3 of such spinning station 2 is shown in FIG. 4), e.g., because of a yarn break, and has been positioned in place thereat, the normal yarn reattachment cycle is started, which as indicated previously is generally known and therefore not shown. In the course of this reattachment cycle, the sliver draw-in arm 22 of the service unit 16 is pivoted into the operating position II represented in FIG. 4 and is coupled to the draw-in roller 49 of the spinning box 3.

In this operating position II of the sliver draw-in arm 22, the suction nozzle 41 is positioned in the area below the dirt outlet opening 50 of the opening roller housing 51 and just above the mechanical dirt removal mechanism 52. The suction nozzle 47 is located, slightly laterally offset from and slightly above this area. The suction nozzles 41, 47 are now charged via suction lines 45, 46, which are directly or indirectly connected to a suction air source (not shown), and remove any dirt collected in or adhering to these areas. During the process, the electric motor drive 26 is energized to act through the lever linkage arrangement 29 to laterally displace the suction nozzle 41 and positively increase its effective cleaning range.

As a whole, the cleaning device in accordance with the invention leads to a clear reduction of the manual cleaning work necessary heretofore and therefore represents an important advance toward an automatically operating open-end spinning machine.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning machine for producing cheeses comprising:

a plurality of spinning stations, each spinning station having a sliver-opening device with a dirt outlet opening, a mechanical dirt removal device disposed below the respective dirt outlet openings of the sliver opening devices, and a traveling service unit movable along the spinning stations for positioning selectively at any one of the spinning stations for automatically repairing yarn breaks, the service unit having a movable sliver draw-in drive arm and a pneumatic cleaning device, the pneumatic cleaning device comprising at least one suction nozzle supported by the draw-in drive arm for unitary displacement therewith between a resting position and an operating position when the service unit is positioned at the selected one of the spinning stations, the at least one suction nozzle being disposed, when in the operating position at the selected one of the spinning stations, in an area between the sliver opening device of the selected spinning station and the mechanical dirt removal device for cleaning dirt therefrom.

2. An open-end spinning machine for producing cheeses in accordance with claim 1, wherein the cleaning device has an angled frame fastened on the side of the draw-in arm.

3. An open-end spinning machine for producing cheeses in accordance with claim 1, wherein the cleaning device comprises a lever linkage arrangement for laterally displacing the suction nozzle.

4. An open-end spinning machine for producing cheeses in accordance with claim 3, wherein the cleaning device comprises an electrical motor for driving the lever linkage arrangement to displace the suction nozzle.

5. An open-end spinning machine for producing cheeses in accordance with claim 4, wherein the cleaning device comprises an eccentric drive connecting the electric motor drive with the lever linkage arrangement for reciprocatory displacement of the suction nozzle.

6. An open-end spinning machine for producing cheeses in accordance claim 1, further comprising another suction nozzle disposed above the first-mentioned suction nozzle to apply suction on an upper area of the sliver opening device.

* * * * *